US006471622B1

(12) United States Patent
Hammer et al.

(10) Patent No.: US 6,471,622 B1
(45) Date of Patent: Oct. 29, 2002

(54) LOW-PROFILE FOLDING, MOTORIZED TREADMILL

(75) Inventors: Rodney L. Hammer, Lewiston; Richard Eldon Fry, Logan; William T. Dalebout, Logan; Scott Watterson, Logan; Jeremy Butler, Paradise, all of UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 09/527,042

(22) Filed: Mar. 16, 2000

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 931,394 A * 8/1909 Day ..... 482/54
3,650,529 A 3/1972 Salm et al.
4,679,787 A 7/1987 Guilbault
5,868,648 A 2/1999 Coody et al. ..... 482/54

* cited by examiner

*Primary Examiner*—Glenn E. Richman
(74) *Attorney, Agent, or Firm*—Workman, Nydegger & Seeley

(57) ABSTRACT

A treadmill having a motorized treadbase and a folding handrail fold is with respect to the treadbase such that the treadmill achieves a low profile when the handrail is in a folded position. The treadmill includes: (i) a treadbase, the treadbase comprising first and second rollers and an endless belt movably trained about the first and second rollers; (ii) a motor coupled to the treadbase, the motor also being movably coupled to the first roller such that the motor selectively turns the first roller, thereby causing the belt to move; and (iii) a handrail pivotally coupled to the treadbase, the handrail selectively folding with respect to the treadbase. In a preferred embodiment, the treadmill is less than about 8 inches in height when the handrail is in a folded position.

29 Claims, 8 Drawing Sheets

LOW-PROFILE FOLDING, MOTORIZED TREADMILL

BACKGROUND OF THE INVENTION

1. The Field of the Invention

This invention is in the field of exercise equipment. More specifically, this invention is in the field of motorized, folding treadmills.

2. The Relevant Technology

The desire to improve health and enhance cardiovascular efficiency has increased in recent years. This desire has been coupled with the desire to exercise in locations that are compatible with working out within a limited space such as within an individual's home or exercise gym. This trend has led to an increased desire for the production of exercise equipment.

Treadmills are a popular form of exercise equipment. Many varieties of treadmills have been produced in order to attempt to satisfy the high demand for treadmills. Folding treadmills have been particularly popular in recent years because of the ability of the folding treadmill to compact into a smaller space when in a storage position. Such folding treadmills efficiently use space within a home or exercise gym. However, even folding treadmills are not always convenient to place under existing furniture or within a small space within an office, home or gym.

Motorized treadmills, which feature a belt driven by a motorized assembly, have also become popular in recent years because they enable a user to exercise at a set, desired speed. However, due to the size of the motor and other components within the treadbase of such treadmills, typical motorized treadmills tend to have a high profile—even when a handrail thereof folds with respect to the treadbase. The size of the motor and related components is often due to the large diameter of a flywheel that is employed to achieve a desired inertia while a user is ambulating on the treadmill. The large size of the flywheel can prevent treadmills from being conveniently moved under a piece of furniture or into a small space within the home, office, or gym of a user.

Furthermore, treadmills are typically difficult to move into a desired space. Even treadmills with wheels thereon must typically be tipped upward and then rolled at an angle into a space where storage is desired. Such treadmills typically feature fixed wheels which rotate about a single axis, therefore making it difficult to move the treadmills from side to side, for example. Another problem with the art relates to the difficulty of achieving a desired, set position for a handrail of a treadmill.

Another problem within the art relates to the cumbersome use of wiring extending between a user interface consul and a motor of the treadmill. Such wiring can be accidentally cut, for example, if not handled carefully, and often requires the manufacturer to thread the wiring through moving parts, such as between the handrail and the treadbase of the treadmill.

SUMMARY OF THE INVENTION

It is therefore an object of the invention to provide a low profile treadmill.

It is another object of the invention to provide a treadmill that can be selectively rolled or slid under a variety of different objects or pieces of furniture within a home, office, or exercise gym.

It is another objection of the invention to provide a treadmill that readily slides on a variety of different services and in a variety of different directions.

It is another object of the invention to provide a treadmill that readily rolls on a variety of different surfaces and in a variety of different directions.

It is another objection of the invention to provide a reliable moving handrail on a treadmill that can be selectively placed into a desired position with respect to a treadbase.

It is another object of the invention to provide a treadmill having a user interface console that readily transmits information without the use of wires extending through moving parts of the treadmill.

It is another object of the invention to provide a treadmill that can be conveniently grasped by a user when moving the treadmill to a desired location.

The present invention relates to a low-profile motorized, folding treadmill that has a height of less than about eight inches in a folded position. Since the treadmill can be folded to such a low profile, the treadmill can be readily moved under a bed or other piece of furniture within a home, office, or exercise gym. Treadmills having a height of less than about seven inches, or less than about six inches in the folded position are also available according to the present invention.

This low-profile dynamic is particularly advantageous because the treadmill is a motorized, folding treadmill. Thus, the advantages of a motorized belt and a low profile folding handrail can be achieved in the same unit. A variety of different motor assemblies are disclosed which assist the user to achieve a desired inertia potential, yet feature flywheels with a relatively small diameter, thereby decreasing the overall height of the folded treadmill.

To enhance the user's ability to move the treadmill, the treadmill can be glided on gliding members or rolled on pivoting wheels which pivot about a vertical axis and roll about a horizontally oriented axis. Thus, the treadmill can be slid or rolled in a front to back, side to side or diagonal orientation while the treadbase remains in a folded, substantially horizontal orientation.

Also, to enhance a user's ability to move the treadmill, handles on the treadbase and/or handrail are disclosed that enable a user to more conveniently grasp the treadmill during movement. The handles may be comprised of a variety of different members, such as a strap coupled to the treadbase, (e.g., the proximal end of the treadbase), a grip coupled to the treadbase, a recess within the treadbase which is defined by a configuration that can be grasped, and a variety of other handle embodiments.

As another unique advantage of the present invention, a handrail positioning assembly is disclosed comprising a shock which allows the user to selectively move the handrail to a desired position, and then move the handrail to another position by actuating a release mechanism. The shock reliably maintains the handrail in a fully upright position, a folded position, and a variety of positions therebetween.

A user console is disclosed which allows a user to achieve wireless communication between the user console, the treadmill belt motor, an incline motor, and other components of the treadmill. The user console folds when the treadmill is in the folded position.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
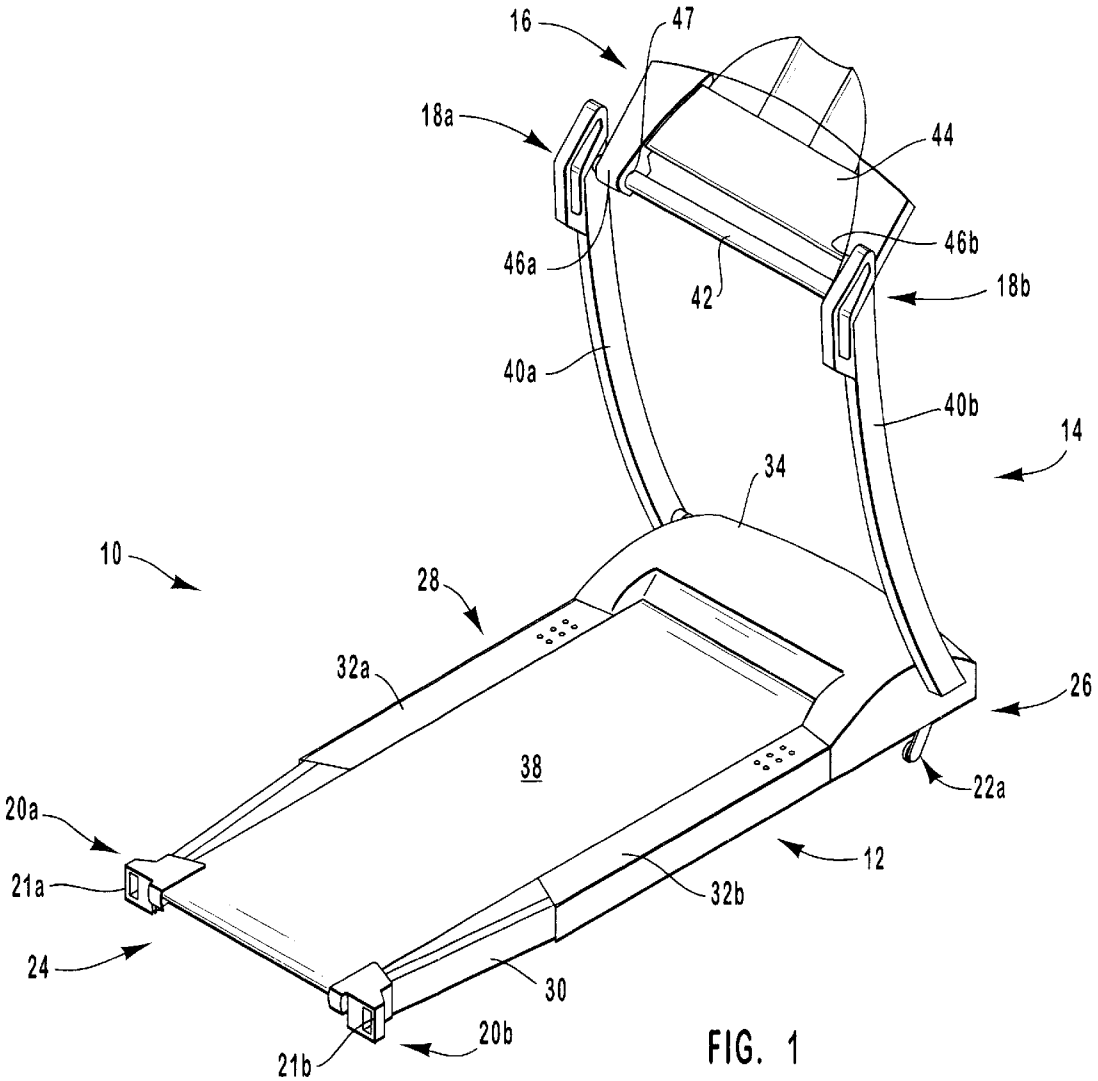
FIG. 1 demonstrates an example of a treadmill of the present invention in an operational position.
Figures 2, 2A:
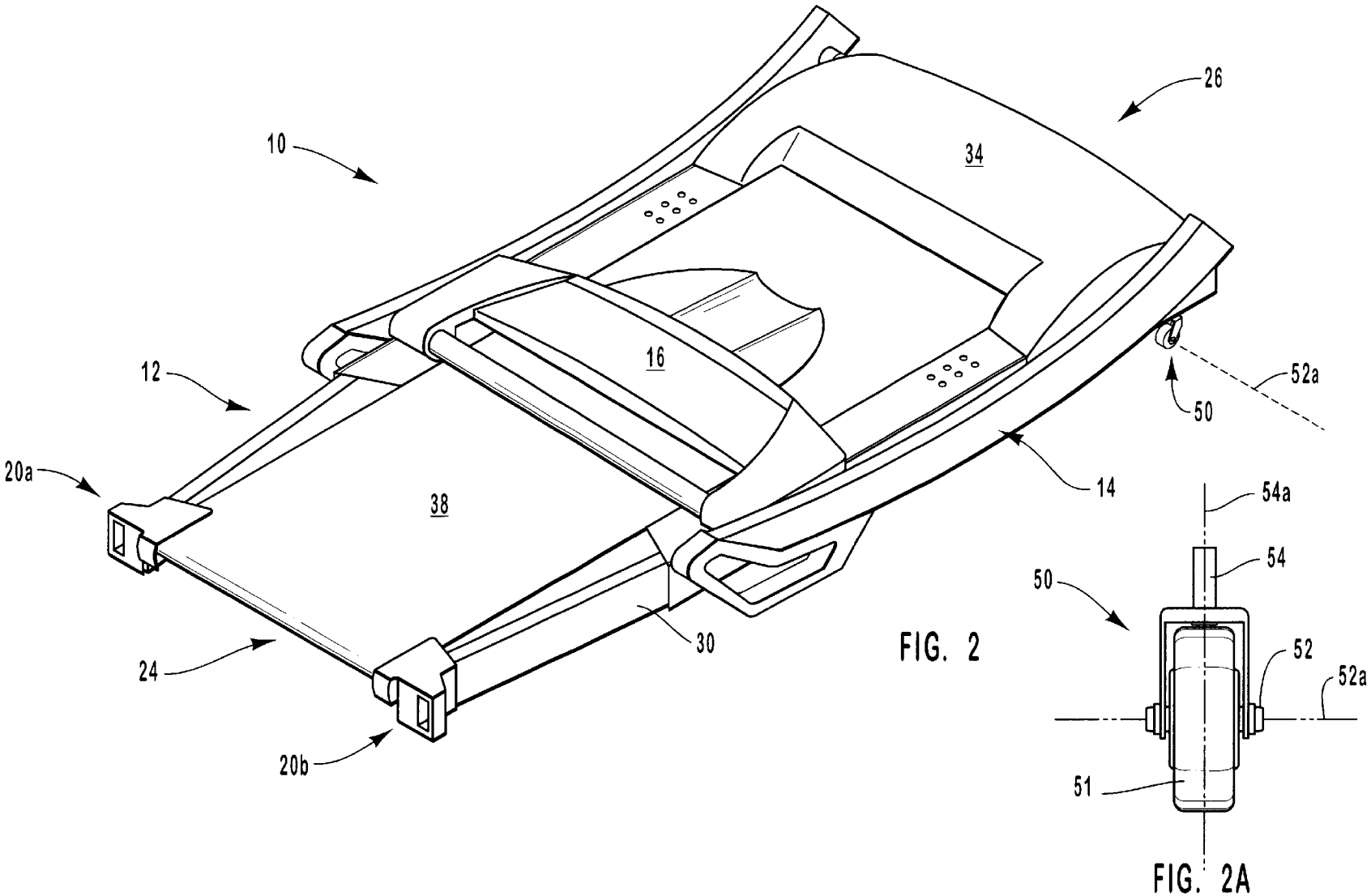
FIG. 2 demonstrates an example of the treadmill of FIG. 1 in a folded position with an optional distal pivoting wheel added to the embodiment shown in FIG. 1.
FIG. 2*a* demonstrates an example of the pivoting castor wheel assembly shown in FIG. 2 which allows the wheel thereof to pivot about a vertical axis and rotate about a horizontal axis.

With reference now to FIGS. 1–2, a low profile, folding, selectively inclining motorized treadmill 10 of the present invention is shown. Treadmill 10 supports a user ambulating thereon in a running or walking mode. Treadmill 10 comprises a selectively inclining treadbase 12, and a folding handrail 14. A user console 16 is pivotally coupled to handrail 14.

Treadmill 10 features a variety of different advantages. Folding handrail 14 folds with respect to treadbase 12 from the operational position of FIG. 1 into a low-profile folded position shown in FIG. 2. By folding into such a tight, compact unit, treadmill 10 can be readily placed under a bed or other piece of furniture within a home, office, or gym.

As another advantage of treadmill 10, user interface console 16 is in wireless communication with the treadmill motor, the inclination motor, and any other components which operate moving parts within treadmill 10. Thus, a wire is not required to extend between console 16 and treadbase 12 in order to operate treadbase 12.

As yet another advantage of treadmill 10, user console 16 selectively pivots on handrail 14 such that console 16 can be positioned into any desired position and can be flattened when treadmill 10 is in a folded position such as shown in FIG. 2.

As another advantage of treadmill 10, handrail 14 features handles 18*a*, 18*b* mounted on handrail 14 that can be employed to selectively move treadmill 10 under a piece of furniture or into a tight space. Handles 18*a*, 18*b* can also be used to raise and lower handrail 14.

As yet another advantage of treadmill 10, handles 20*a*, 20*b* are mounted on treadbase 12 thereby assisting in the movement of treadmill 10 to a desired position, particularly when treadmill 10 is in a folded mode. As yet another advantage of treadmill 10, inclination legs 22*a*, 22*b* are featured, which selectively raise treadbase 12 directly off of a support surface.

Other advantages include a unique handrail positioning assembly comprising a shock for selectively retaining handrail 14 in a desired position as will be discussed in detail below, and unique means for moving treadmill 10 into a desired location such as gliders, pivoting wheels, and fixed wheels and combinations thereof. Each of these will be discussed in greater detail below. In addition, unique motors for use in low profile treadmill 10 are disclosed which enable low profile treadmill 10 to be moved under a desired piece of furniture or into a desired space.

With continued reference now to FIG. 1, treadbase 12 has a proximal end 24, a distal end 26, and an intermediate portion 28 therebetween. Treadbase 12 comprises a frame 30 and first and second side support rails 32*a*, 32*b* coupled to opposing sides of frame 30. A housing 34 is coupled to frame 30 covering the treadbase motor and inclination motor. Treadbase 14 rests on a support surface and selectively inclines with respect to the support surface. Rollers 36*a*, 36*b* (FIG. 3) are movably coupled to opposing ends of treadbase frame 30 and endless treadmill belt 38 is movably trained about rollers 36*a*, 36*b*.

FIG. 1 also demonstrates that handles 20*a* and 20*b* are coupled to proximal end 24 of frame 30. Handles 20*a*, 20*b* enable a user to conveniently move treadmill 10, particularly when treadmill 10 is in a folded position. Handles 20*a*, 20*b* each comprise a grip member 21*a*, 21*b* to be grasped by a user. Other embodiments of handles coupled to treadbase 12 include one or more straps coupled to the treadbase, one or more protuberances coupled to the treadbase. The treadbase can have a configuration therein which defines a recess, the configuration capable of being grasped by a user. The user reaches inside the recess to grasp the configuration, which may be a grip or a graspable protrusion or surface.

Handles 20*a*, 20*b* are configured with a glider 33 (FIG. 7) on a lower surface thereof. Glider 33 is capable of gliding on a support surface. Thus, treadmill 10 can be glided along a support surface, rather than requiring treadmill 10 to be rolled. Gliding the treadmill 10 is a convenient method for moving the treadmill and is particularly useful when pressing low profile treadmill 10 below an item of furniture, for example. The glider of the present invention is optionally mounted separately from a handle on the frame of the treadbase without being part of the handle assembly 20*a* or 20*b*. However, since handles 20*a*, 20*b* each comprise a grip and a glider, they are advantageous for a variety of different reasons. Gliders of the present invention are mounted on the lower surface of the treadbase such that they contact a support surface.

The gliders of the present invention can be comprised of a smooth polymeric material, such as nylon or PVC, for example, which readily glides on a carpeted surface and/or a felt material, which readily slides on a wood surface. A reversible glider comprising felt on one side and a smooth polymeric material may also be employed in the present invention, as discussed below.

Such gliders can be mounted on the distal comers of treadbase 12 and the proximal comers of treadbase 12. Optionally, first and second gliders can be mounted on the distal portion of treadbase 12 while a single glider is mounted on the proximal portion of treadbase 12. Also optionally, a single glider may be mounted on the distal portion of treadbase 12 while first and second gliders are mounted on a proximal portion of treadbase 12. A variety of other combinations are possible such that one or more gliders are mounted on the lower surface of treadbase 12 to allow gliding of treadbase 12 along a desired surface. Such gliders may be mounted at one or more comers of treadbase 12 or in the middle portion of treadbase 12 or in a variety of different positions on treadbase 12.

A major advantage of such gliders is that they enable treadmill 10 to be moved while treadmill 10 is flat or substantially flat, rather than requiring a user to tilt the treadmill before moving treadmill 10 from one location to another.

Figure 10:
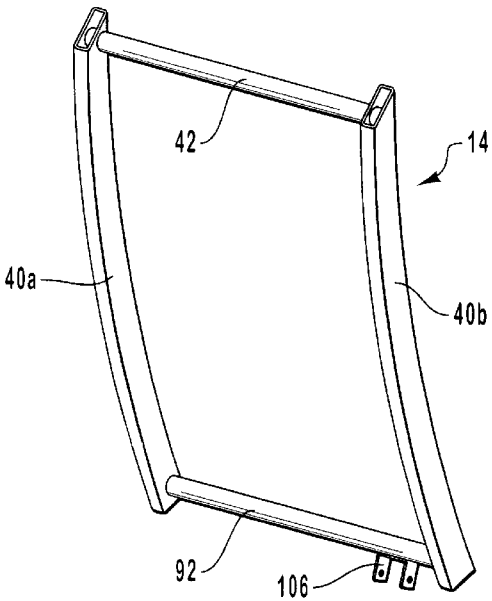
FIG. 10 demonstrates an example of a handrail of the present invention which is pivotally coupled to the treadbase of the treadmill of FIG. 1.

Also as shown in the embodiment of FIGS. 1 and 2, handrail 14 (depicted in FIG. 10) is pivotally coupled to frame 30. As shown in FIGS. 1, 2 and 10, handrail 14 comprises first and second upright members 40*a*, 40*b*, an upper cross member 42 coupled therebetween, a lower cross member 92 (FIG. 3) coupled therebetween, and a bracket 106 (FIG. 3) coupled to the lower cross member 92 However, the handrail of the present invention may have a variety of configurations which allow the handrail to be pivotally coupled to the treadbase of the present invention. For example, the handrail may comprise a single rail which is pivotally coupled to a treadbase.

With continued reference to FIG. 1, user interface console 16 is rotatably coupled to upper cross member 42 of handrail. Console 16 comprises a body portion 44 and first and second arms 46*a*, 46*b* extending rearwardly therefrom. Arms 46*a*, 46*b* each have an aperture 47 therethrough. Arms 46*a*, 46*b* are mounted on upper cross member 42, with upper cross member 42 extending through the apertures 47 of arms 46*a*, 46*b*.

The apertures 17 of arms 46*a*, 46*b* are toleranced such that console 16 can be selectively, rotated to its desired position and is retained in that position until moved again by the user. Console 16 can be rotated 360 degrees about upper cross member 42. Console 16 can be rotated frontwardly or rearwardly to be selectively placed in folded position shown in FIG. 2. Console 16 may be comprised of a polymeric material, for example, such as ABS plastic, for example.

FIG. 2 demonstrates that a variety of different members fold on treadmill 10. Handrail 14 is shown in an operational position in FIG. 1 and in a folded position in FIG. 2. Console 16 is shown in a folded position in FIG. 2. Treadbase 12 is shown in an inclined position in FIG. 1 and in a declined position in FIG. 2.

In one embodiment, in the folded position of FIG. 2, the height of treadmill 10 at its highest point is less than about 8 inches. In another embodiment, in the folded position of FIG. 2, the height of treadmill 10 at its highest point is less than about 7 inches. In another embodiment, in the folded position of FIG. 2, the height of treadmill 10 at its highest point is less than about 6 inches. In another embodiment, in the folded position of FIG. 2, the height of treadmill 10 at its highest point is less than about 5 inches.

This size ratio of treadmill 10 is a major advantage of treadmill 10, allowing it to be moved, e.g., by being slid or rolled under a variety of different pieces of furniture such as beds, desks and other objects or spaces within a home, office or exercise gym.

In the embodiment of FIGS. 2 and 2*a*, treadmill 10 further comprises rotating castor wheel assembly 50 coupled to frame 30. Assembly 50 feature wheels 51 which roll about a horizontally oriented axis 52*a* and pivot about a vertically oriented axis 54*a*. For example, in the embodiment of FIGS. 2 and 2*a*, wheels 51 roll on a horizontally oriented pivot pin 52 and pivot on a vertically oriented pivot pin 54. Thus, wheels move in a front to back, side to side and diagonal motion. Consequently, treadmill 10 can be rolled in a variety of different directions. This is particularly useful when rolling treadmill 10 under a bed or other piece of furniture. Such castor assemblies 50 may be mounted at one or more corners of treadbase 12 (e.g., the proximal comers or distal comers of treadbase 12) or in the middle portion of treadbase 12 or in a variety of different positions on treadbase 12.

Thus, it is possible to glide treadmill 10 using one or more gliders, as shown in FIG. 1, or it is possible to roll treadmill 10 using one or more castor assemblies 50, as shown in FIG. 2. In another embodiment, treadmill 10 features one or more castor assemblies 50 on one portion of treadmill and one or more gliders on another portion of treadmill 10. For example, it is possible to mount one or more gliders on a distal portion of treadmill 10 while mounting one more more castor assemblies 50 on a proximal portion of treadmill 10 and vice versa. Optionally, it is possible to mount on or more fixed wheel assemblies 53 that rotate only about a horizontal axis (such as shown in FIG. 4) on treadmill 10 (e.g., at distal end 26) in conjunction with one or more castors 50 and/or gliders.

It can be seen from the folded position of FIG. 2 that it is convenient for a user to grasp handles 20(*a*), 20(*b*) and selectively roll and/or slide treadmill 10 under a bed or under another piece of furniture. This rolling or sliding can occur through the use of castors 50 and/or through the use of gliders on the lower surface of treadbase 12. Treadbase 10 may be slid or rolled without having to hold treadmill 10 at an angle.

Also as shown in the combined views of FIGS. 1 and 2, treadbase 12 selectively moves between a neutral position shown in FIG. 2, and an inclined position, shown in FIG. 1. The inclining mechanism of the present invention will be described in additional detail below.

Figure 3:
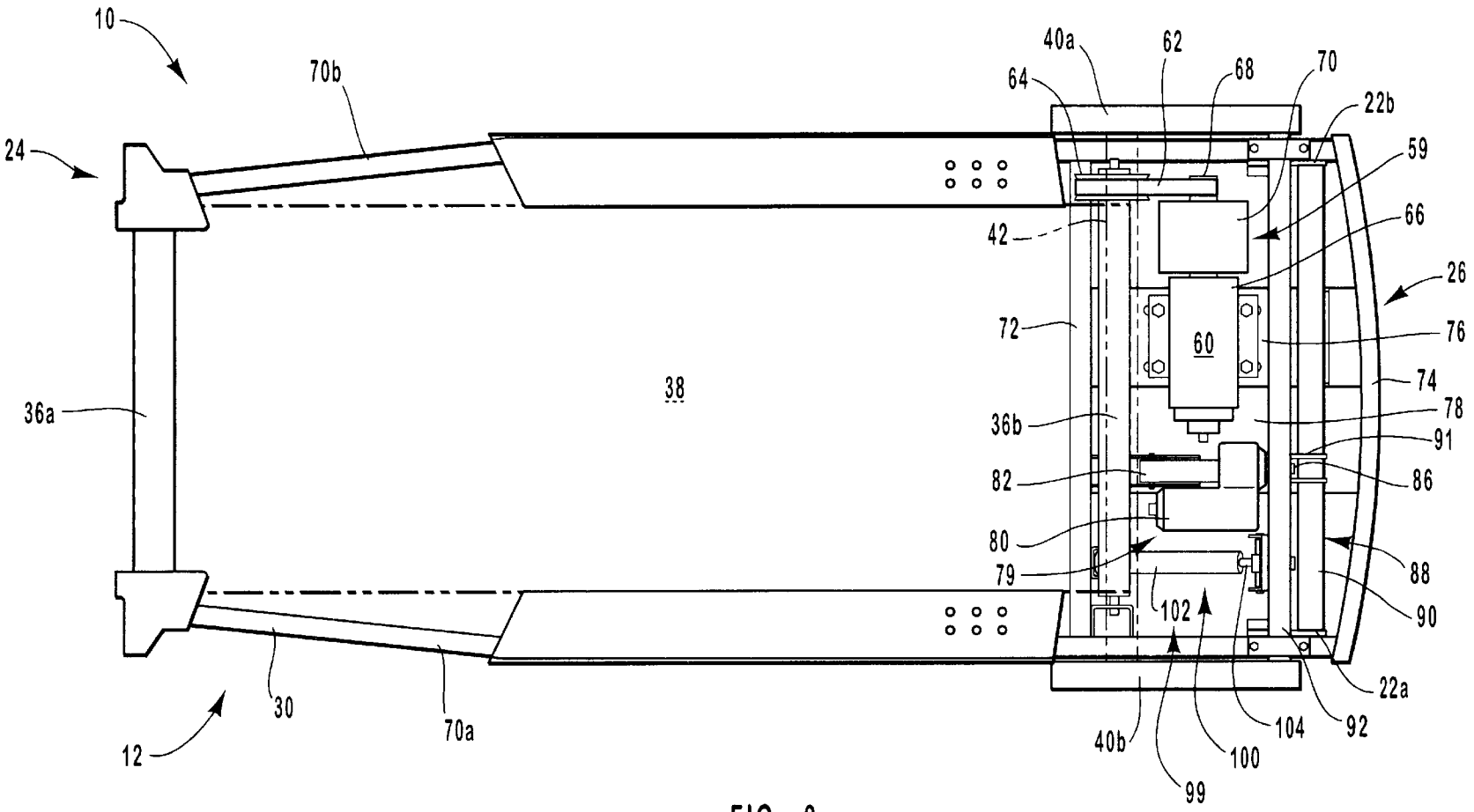
FIG. 3 demonstrates an example of the treadmill of FIG. 1 from a top view with the front housing removed and with the treadmill belt shown in phantom lines.
Figure 4:
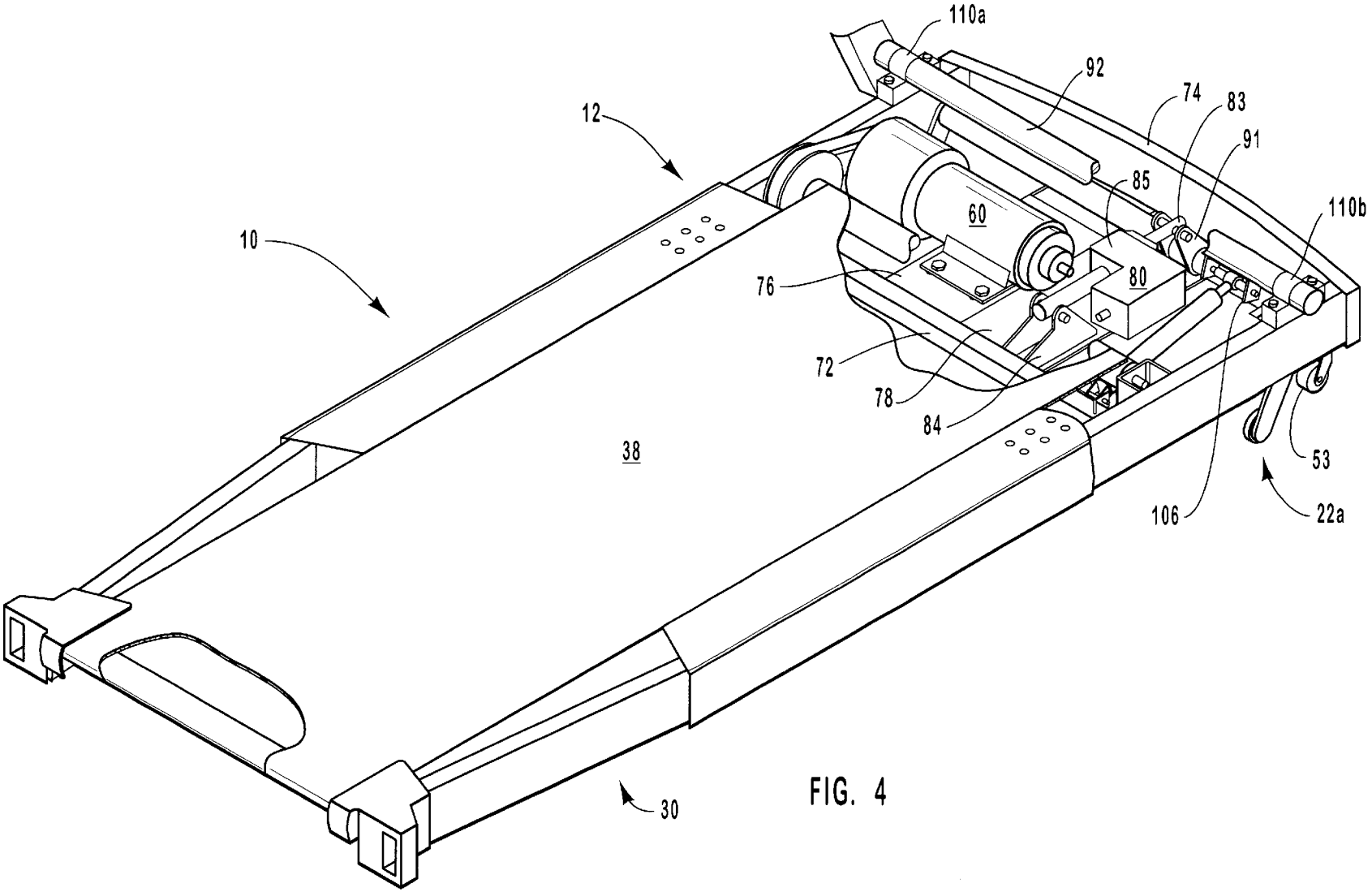
FIG. 4 demonstrates an example of the treadmill of FIG. 1 from a perspective, cutaway view with an optional distal fixed wheel added to the embodiment shown in FIG. 1.

With reference now to FIGS. 3 and 4, a variety of features of treadmill 10 will now be discussed in additional detail including: (i) treadbase frame 30; (ii) treadbase motor assembly 59; (iii) treadbase inclining assembly 79; and (iv) handrail positioning assembly 99.

Frame 30 comprises first and second side members 70*a*, 70*b* that extend from a proximal end 24 to a distal end 26 of treadbase 12. Frame 30 further comprises a first cross member 72 extending between first and second side members 70*a*, 70*b* and a second cross member 74 extending between side members 70*a* and 70*b*. Between cross members 72 and 74 extends a first plate 76 and a second plate 78. First and second plates 76, 78 thus extend between first and second cross members 72, 76. Motor 60 of motor assembly 59 is coupled to first plate 76 and bracket 84 (FIG. 4) of inclining assembly 79 is coupled to second plate 78.

Treadbase motor assembly 59 comprises: (i) a motor 60 coupled to frame 30; (ii) a pulley 64 coupled to roller 36*b*; (iii) a drive belt 62 mounted on motor 60 and pulley 64; (iv) a drive shaft 68 and (v) a flywheel 70 coupled to drive shaft 68. Actuation of motor 60 rolls roller 36*b*, thereby turning endless belt 38.

Although flywheel 70 is shown as being coupled to drive shaft 68, it is possible to orient flywheel 70 into a variety of different positions, as will be discussed in greater detail below. Furthermore, it is possible to employ a variety of different variations from flywheel 70 shown in FIGS. 3 and 4. For example, in order to decrease the diameter of a single flywheel, yet preserve the same or more inertia potential, it is possible to employ first and second flywheels (or third, fourth, etc.), which have a smaller diameter than a single flywheel yet collectively provide the same or more inertia potential.

Figure 9:
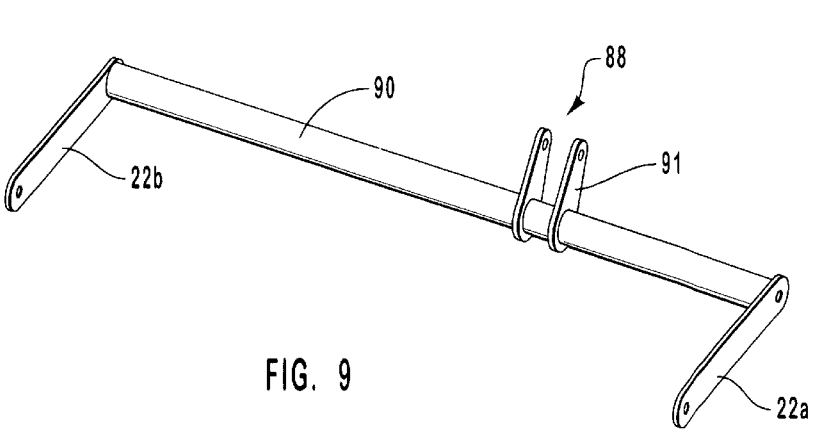
FIG. 9 demonstrates an example of an incline mechanism of the present invention which is pivotally coupled to the treadbase of the treadmill of FIG. 1.

With continued reference now to FIGS. 3 and 4, treadmill 10 further comprises treadbase inclining assembly 79. Treadbase inclining assembly 79 comprises an incline motor 80 pivotally coupled between frame 30 and incline mechanism 88 (featured in FIG. 9). Incline motor 80 is pivotally coupled at a proximal end 82 thereof to bracket 84 (coupled to plate 78) and is pivotally coupled at a distal end 86 thereof to bracket 91 of incline mechanism 88. Bracket 91 is affixed to cross bar 90.

Incline mechanism 88 comprises a crossbar 90, feet 22*a*, 22*b* extending therefrom and bracket 91. Crossbar 90 is pivotally coupled to opposing side members 70*a*, 70*b* of frame 30 of treadbase 12. Feet 22*a*, 22*b* preferably have wheels thereon that roll on a support surface.

Incline motor 80 is an example of a linear extension assembly having a first member 83 which selectively moves with respect to a second member 85. Examples of linear extending assemblies having a first member which selectively moves with respect to a second member and which may be employed in the present invention to move an incline mechanism include: a ram such as a hydraulic or pneumatic ram, a drive screw with an accompanying nut or internal threading, a linear actuator, an extension motor, a piston, a shock, another telescoping assembly, and any other assembly having a first member which is selectively linearly extended with respect to a second member.

Upon actuation of incline motor 80 incline mechanism 88 selectively moves. When incline motor 80 is in a contracted position as shown in FIG. 4, feet 22*a*, 22*b* are lowered, thereby inclining treadbase 12. When incline motor 80 is in an extended position, feet 22*a*, 22*b* are raised.

With continued reference to FIGS. 3 and 4, handrail positioning assembly 99 is shown. As mentioned above, handrail 14 is pivotally coupled to frame 30. A lower cross member 92 of handrail 14 is shown in FIGS. 3–4 pivotally coupled to frame 30. Lower cross bar 92 is pivotally coupled to frame 30 through the use of first and second brackets 110*a*, 110*b* mounted on frame 30. Handrail positioning assembly 99 is an example of a means for retaining handrail 14 in a desired position.

Handrail positioning assembly 99 comprises a shock 100 having a barrel 102 and an extending rod 104 moveably coupled thereto. Rod 104 selectively slides into and out of barrel 102. Shock 100 is pivotally coupled at a proximal end thereof to cross member 72 of frame 30 and pivotally coupled a distal thereof to lower cross member 92 of handrail 14. As shown in FIG. 3, bracket 106 extends from lower cross member 92 to which shock 100 is pivotally coupled.

In one embodiment, shock 100 comprises a gas shock which presses rod 104 outwardly unless a force generated by a user presses rod 104 into barrel 102. However, shock 100 may also comprise a spring or an elastomeric material which forces rod 104 outwardly unless rod 104 is pressed inwardly by the user. Shock 100 will be discussed in further detail with reference to FIGS. 5 and 6. Other linear extending assemblies, such as discussed above, may be employed rather than shock 100, however, to selectively position handrail 14.

Figure 5:
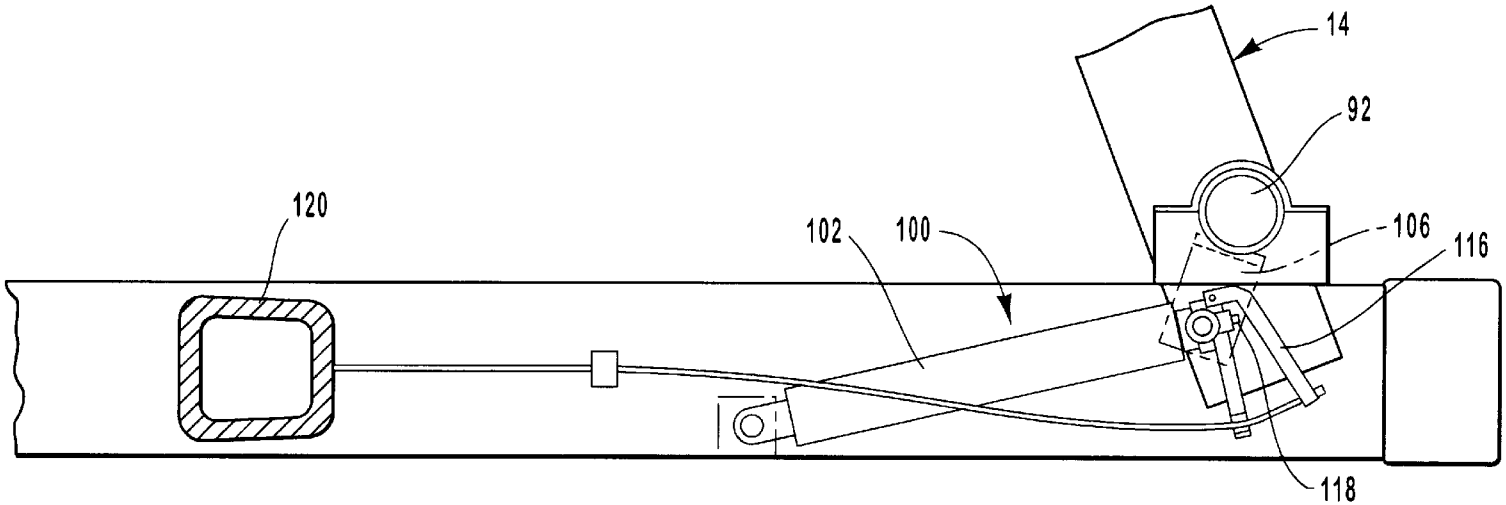
FIGS. 5 and 6 demonstrate an example of a handrail positioning assembly of the present invention in contracted and extended views, respectively.
Figure 6:
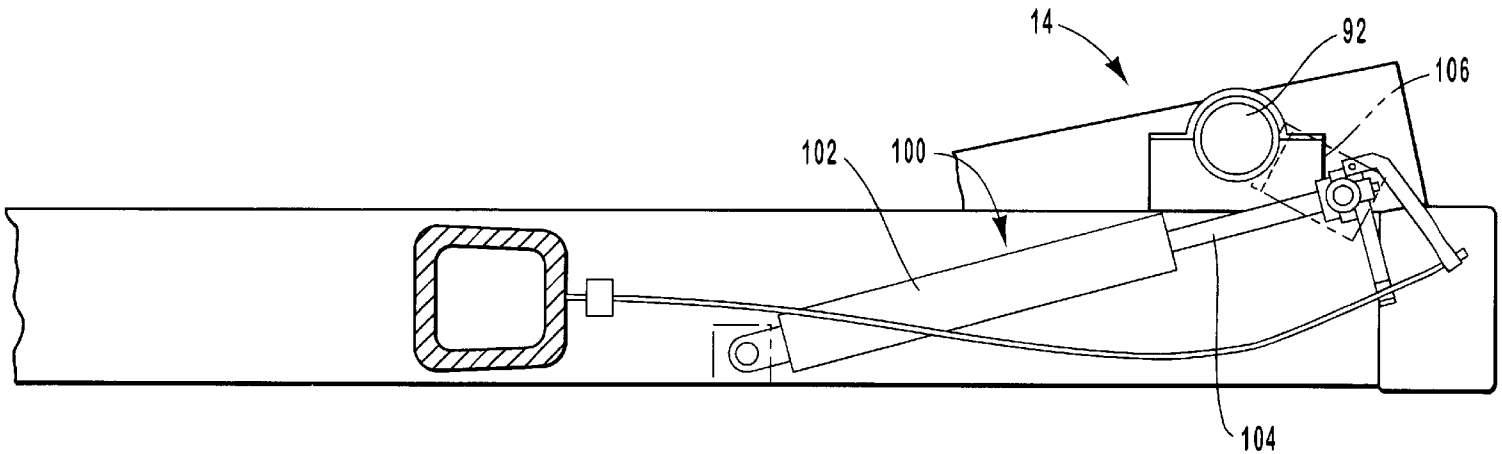

Shock 100 is shown in a contracted view in FIG. 5 and in an extended view in FIG. 6. In the contracted position of FIG. 5, handrail 14 is in an upper, operational position, while in FIG. 6 when shock 100 is extended, handrail 14 is featured in a lower position.

As shown in FIGS. 5 and 6, shock 100 further comprises a moveable trigger 116 pivotally coupled to rod 104. Upon moving trigger 116 against actuation pin 118 coupled to rod 104, shock 100 is placed in a moveable mode and rod 104 can be moved. Thus, in use, a user actuates trigger 116 by moving trigger 116 against actuation pin 118, such as through the use of handle 120 coupled to trigger 116. Depression of pin 118 actuates shock 100 into a moveable mode. When shock 100 is in the movable mode, the user can selectively move handrail 14 from the folded position to the operational position or vice-versa. A user can actuate trigger 116 against actuation pin 118 through the use of handle 120, another handle, or a variety of different mechanisms.

As one advantage of the use of shock 100, a user can move handrail to a fully upright position, a folded position, or a variety of different positions therebetween. Shock 100 reliably holds handrail 14 in a desired position until actuation pin 118 is actuated, after which the user can move handrail.

Figure 7:
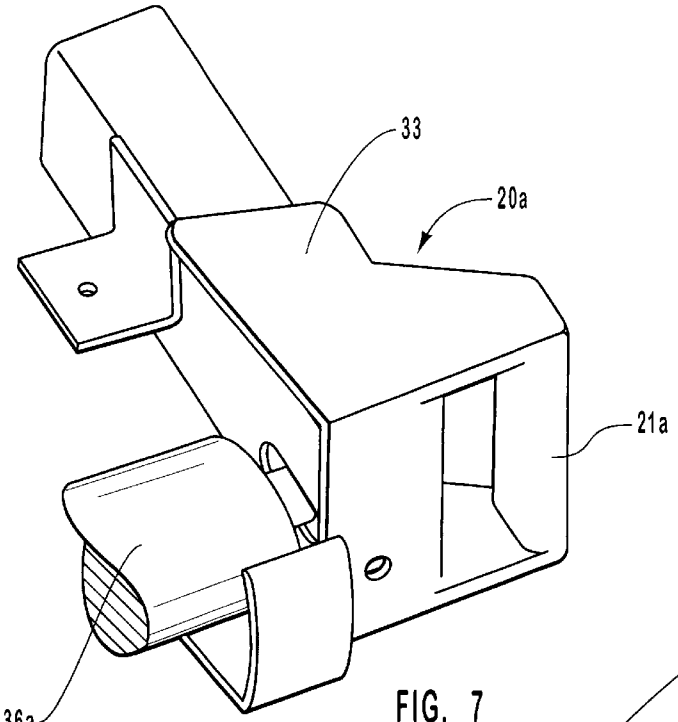
FIG. 7 demonstrates a view of the lower surface of a proximal comer of the treadbase of the treadmill shown in FIG. 1, showing a glider used to slide the treadmill on a support surface.

With reference to FIG. 7, which features the lower surface of handle 21*a* on the comer of treadbase 12, glide 33 is coupled to the lower surface of treadbase 12. Optionally, a glide separate from a handle may be coupled to the treadbase of the present invention.

Figure 8:
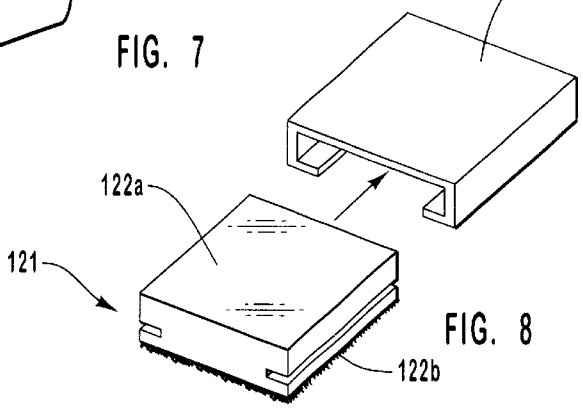
FIG. 8 demonstrates a view of a reversible glider of the present invention which can be selectively affixed to the lower surface of the treadbase of the treadmill of FIG. 1, the glider having a smooth polymeric side and an opposing felt side. A glider mount is also shown into which the glider is selectively mounted.

In the embodiment of FIG. 8, a reversible glide member 121 is shown. Glide 121 may be coupled to any portion of the lower surface of treadbase 12. In one embodiment, first and second glide members 121 are coupled to the distal comers and/or the proximal comers of treadbase 12. Glide 121 comprises a smooth polymer surface 122*a* for gliding on carpet and a felt surface 122*b* or a surface comprising another soft, deformable material for gliding on wood. Glide 121 may be selectively screwed or bolted to treadbase 12.

Optionally, however, glide 121 is selectively coupled to glide mount 123 which is affixed to treadbase 12, the grooves on the sides of glide 121 selectively mating with the ridges in glide mount 123. Glide 121 may be selectively coupled to glide mount 123 with either side 122*a* or 122*b* down. Glide 121 and mount 123 collectively form a reversible glide assembly. A plurality of such assemblies may be mounted on the lower surfaces of treadbase 12, such as on the lower proximal and/or distal comers of the treadbase 12.

Mount 123 may be coupled to the treadbase through a variety of different means, such as through the use of an adhesive, screws, bolts, or other coupling means.

Figure 12:
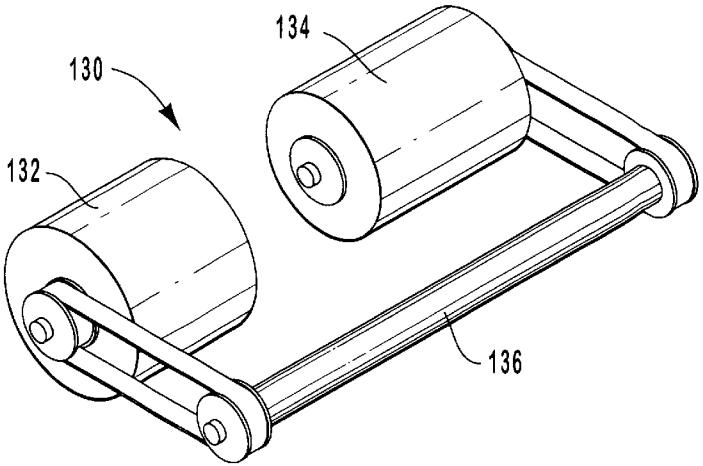
FIGS. 11–13 feature alternate examples of motor assemblies of the present invention, the motor assemblies comprising a motor and a least one flywheel movably coupled to the flywheel.
Figure 11:
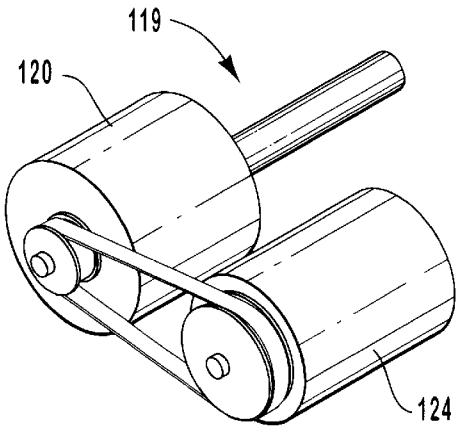
Figure 13:
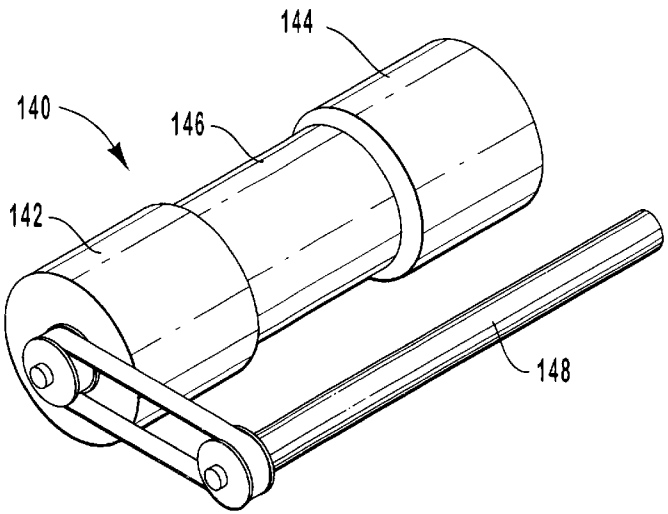
Figure 14:
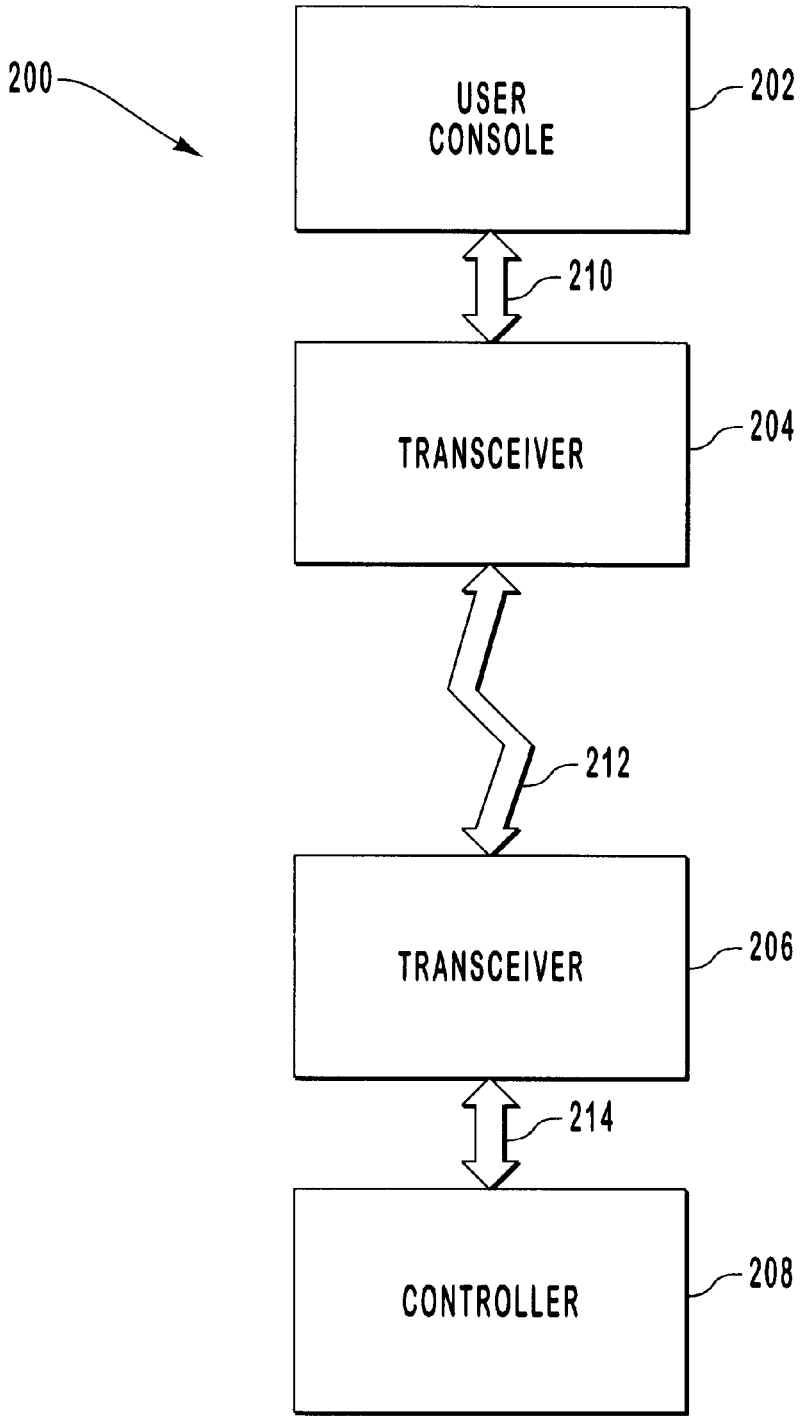
FIG. 14 is an example of a block diagram illustrating dataflow between a user console (such as the console in FIG. 1) and a controller across a wireless communication network.

With reference now to FIGS. 11 through 13, a variety of different motor assemblies of the present invention may be employed. In the motor assembly of FIG. 10, motor 124 is movably coupled to flywheel 120 through the use of a drive belt. Flywheel 120 is coupled to a roller 119 of a treadbase about which a moving belt can be trained. By mounting flywheel 120 separately from motor 120, as shown in FIG. 11, it is possible for flywheel 120 to achieve a faster speed and therefore a greater inertia potential. For example, a gear reduction may be employed between motor 124 and flywheel 120, such as by having a larger pulley coupled to the motor and a smaller pulley coupled to the flywheel 124. Thus, by separating motor 124 from flywheel 120 it is possible to achieve a desired amount of inertia potential while nevertheless employing a flywheel 120 having a reduced diameter. Thus, the motor assembly of FIG. 11 can be employed in the low profile treadmill of the present invention in order to decrease the overall height of the folded treadmill without reducing the inertia potential.

The motor assemblies of FIGS. 12 and 13 can also be employed in the present invention to decrease the overall height of the folded treadmill without reducing the inertia potential. In the embodiment of FIG. 12, motor assembly 130 comprises a motor 134 movably coupled to a roller 136, such as a treadbase roller 136, which is movably coupled to a flywheel 132 separate from the roller 136. This embodiment also allows for a gear reduction which allows flywheel 132 to have increased speed and therefore increased inertia potential.

In another embodiment of dual flywheels shown in FIG. 13, motor assembly 140 comprises first and second flywheels 142, 144 which are mounted on opposing sides of a drive shaft of a motor 146, the drive shaft being coupled to a treadbase roller 148. In another embodiment, however, the flywheels are on the same side of the drive shaft. By employing a plurality of flywheels 142, 144, each individual flywheel can have a smaller diameter without sacrificing desired inertia potential.

The motor assemblies of FIGS. 11–13 can thus be employed in the low profile treadmill of the present invention in order to achieve a desired inertia potential without raising the height of the treadmill above a desired height. As another possible mechanism for increasing inertia, it may be possible to employ a controller for controlling the treadbase motor which causes the motor to give short bursts of energy to a flywheel and/or moving belt over a period of time, thereby compensating for any slowing of the belt caused by the movement of the user.

The treadmill 10 of the present invention conveniently fits under a variety of different pieces of furniture or into a variety of different spaces within the home of a user. Thus, the present invention also relates to a system and method for storing a treadmill. The system comprises treadmill 10 or another low profile treadmill disclosed herein. In another embodiment, the system comprises means for raising an item of furniture such as a bed, if such is needed for additional clearance. The means for raising the furniture may comprise castors or blocks or some other object on which the furniture is mounted, if additional height is needed.

In yet another embodiment of the system for storing a treadmill, the item of furniture has a track, frame, or recess which receives the treadmill therein. For example, a bed or chest or drawers may rest on the ground and have a recess therein which receives the treadmill therein. The recess may have track therein on which the treadmill slides or rolls, for example. A door to the furniture may selectively open and close. Thus, the treadmill may be slid, rolled or otherwise placed into the item of furniture, after which a door closes, maintaining the treadmill in the furniture item in an aethestically pleasing condition.

Reference is next made to FIG. 13, a block diagram illustrating dataflow between a user interface console 202 (such as console 16 in FIG. 1) and a controller across a wireless communication network. In one embodiment of the present invention, the treadmill 10 comprises a wireless data and control network 200 between an electronic user console 202 and a controller 208. Console 202 can be electrically coupled to the console transceiver 204 via a bidirectional high-speed data bus 210.

Console transceiver 204 is in wireless communication with the treadbase transceiver 206 via a short-range wireless communication network 212. The treadbase transceiver 206 is electrically coupled to controller 208 via the high-speed control and feedback bus 214. In one embodiment, the controller 208 controls the endless belt motor and the inclination motor. Controller 208 can interpret feedback from the exercise device and user interface console 202 to generate control signals for the aforementioned motors, braking systems, monitors and moving parts associated with the treadmill. The received control signals from the exercise device components and user interface console 202 may be compiled into control functions for use by the controller. The controller 208 and treadbase transceiver 206 may be mounted beneath housing 34, for example.

Through the use of console 202, the user can control the amount of inclination/declination of treadbase, the speed of the endless belt, and a variety of other features related to exercise apparatus. Other features of the exercise system include the incorporation of various input keypads on the user interface console 202 for setting grade and speed.

User interface console 202 may contain a display device and a control interface. In one embodiment the display device comprises various workout diagnostic panels. The workout diagnostic panels may display workout information on at least one panel of said user interface console 202. Such workout information may comprise at least one of: speed of endless belt, percentage of workout completion, distance traveled, relative workout segment difficulty, remaining workout segment length, selected workout routine, and information about the workout profile, for example. The control interface is an example of an interface means for receiving workout related control inputs, such as a keypad.

In another embodiment of a user console, the display device of the console is located remotely from the exercise apparatus. For example, the display device may comprise a wall mounted or hand held display. Control interface on the user console 202 may comprise several individual adjustment keypads for interfacing with the selectively adjustable exercise apparatus. For example, a grade adjustment keypad may allow the user to select a desired grade of an operable member of the selectively adjustable exercise apparatus through quick touch keys with pre-set percentage grade values and automatically adjust the device to the selected level.

Specifically, grade adjustment keypad may have pre-set percentage grade keys for—5%, 0%, 10%, 20%, 30%, 40%, 50%, and 60% grade, for example, although a variety of different grades are available. Upon reception of user input from user interface console 202, controller 208 may increase the grade or resistance depending on the attached exercise device. Similarly, inclination and declination interface buttons, included in the grade adjustment keypad, may allow a user to increase or decrease the grade in pre-set grade intervals, for example 1% grade intervals.

A start interface button on the user interface console 202 allows a user to begin the workout once selected or the previous workout segment has been restored. A stop/pause interface button allows a user to stop or pause the workout and save the location of the user's workout for future use. A speed adjustment keypad on the user interface console 202 allows the user to adjust the speed of the particular exercise device. Specifically, the speed adjustment keypad may have preset keys for 0.5, 1.0, 1.5, 2.0, 3.0, 4.0, 5.0 and 6.0 mph, for example. In addition to the aforementioned preset speed values, increase and decrease buttons increase or decrease the selectively adjustable exercise apparatus operable member (endless belt) speed in $1/10^{th}$ intervals. In one treadmill configuration, the treadbase will gradually increase the belt speed according to the inputs from the user interface console 202.

An incremental adjustment keypad contains an increment and decrement input keys as well as a final enter input key. One embodiment allows a user to input their age through this keypad so that the exercise system can customize a workout and monitoring system. Another embodiment allows a user to use this keypad to enter one or more of the following workout variables: the exerciser's age, length of workout segment, distance of workout segment, maximum speed of workout segment, maximum pulse, target heart rate, maximum grade, calories to be burned, and maximum heart rate. These keys may also be used along with the workout panel to specifically select a workout segment, making adjustments in the present workout profile, or even to select different workouts.

Once the user has selected the desired control settings on the user interface console 202, the information is transmitted along the high-speed data bus 210 to console transceiver 204. Console transceiver 204 is in wireless communication with treadbase transceiver 206 via a short-range wireless communication network 212. While long-range wireless standards such as cellular and digital may be available and well defined, the near proximity use of near and even co-located console 202 and controller 208 devices wants for the use of a short-range wireless standard. One such short-range wireless standard that is in the process of being embraced by the electronics industry is preliminarily known by the name of "Bluetooth."

Bluetooth, which is only one example of a short-range wireless standard, is actually a combination of specialized computer chips and software. Bluetooth is the codename for a technology specification for small form factor, low-cost, short-range radio links between mobile PCs, mobile phones and other portable devices. These short-range wireless standards, such as Bluetooth, use radio waves to transmit information, link gadgets as far as 30 feet away, and even those devices in different rooms that are not in the line of sight. Bluetooth, for example, also offers speedy transmission of up to one megabyte per second, over 17 times as fast as a typical modem. These standards enable users to connect a wide range of digital, computing, and telecommunications devices easily and simply, without the need to buy, carry, or connect cables. They deliver opportunities for rapid ad hoc connections, and the possibility of automatic, unconscious, connections between devices. They may virtually eliminate the need to purchase additional or proprietary cabling to connect individual devices. Because these standards can be used for a variety of purposes, they will also potentially replace multiple cable connections via a single radio link. It is important for a communication center to be short-range wireless capable, in view of this potential. Unfortunately, short-range wireless interface chips can add tens of dollars to the price of a gadget, which is expensive for low-cost low-margin devices like a computer mouse, a coffee pot or even a mobile phone, which manufacturers often give away as part of service deals. In addition, Bluetooth's short-range wireless standards approximate 30-foot range is considered too short to network all home electronics, but is perfect for the wireless communication needed in the exercise device between console 202, controller 208, and other wireless peripherals, such as a heart monitor or iFit.com connection. Presently, the Bluetooth connection in accordance with short-range wireless specifications will have an operational range of around ten meters from the transceiver.

Other acceptable wireless protocols for the short-range wireless communication network 212 include RF, IR, 802.11 RF, 900 MHz, and other acceptable short-range wireless protocols. In short, the wireless communication network may include transmitters and receivers capable of interpreting radio frequency transmissions, optical transmissions, electromagnetic waves, or other wireless transmission medium. The short-range wireless functionality of the short-range wireless communication network 212 also allows the exercise device to expand through Bluetooth, 802.11 RF, Infared, RF, or other short-range wireless capable peripheral devices.

The controller 208 may be a microcontroller, a central processing unit (CPU), a state machine, a programmable logic array, or network of logical gates, ASIC processor, software-based controller, a combination of these components, or a variety of other controllers. Each of these controller examples are examples of processor means for electronically computing operational information based at least in part on control inputs received from an interface means. The controller receives feedback signals from the treadmill and a workout profile and converts the feedback signals into control signals for the display device and exercise apparatus. Data for the controller may be stored in registers or memory modules. In one embodiment, the controller includes a temporary storage media for use with the display device on the user interface console. The temporary storage media provides a buffer for each of the displayed values, such as speed of endless belt, pulse, heart rate, average pulse and heart rate, target heart rate, calories burned and target calories to burn during workout session, length of workout session, and other displayed values. This multi-buffer system allows for the simple control and rapid refresh of the user workout data.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A treadmill having a motorized treadbase and a folding handrail, the handrail folding with respect to the treadbase such that the treadmill achieves a low profile when the handrail is in a folded position, the treadmill comprising:

a treadbase, the treadbase comprising first and second rollers and an endless belt movably trained about the first and second rollers;

a motor coupled to the treadbase, the motor also being movably coupled to the first roller such that the motor selectively turns the first roller, thereby causing the belt to move; and a handrail pivotally coupled to the treadbase, the handrail selectively folding with respect to the treadbase, such that the treadmill is less than about 8 inches in height when the handrail is in a folded position.

2. A treadmill as recited in claim 1, wherein the treadbase selectively inclines.

3. A treadmill as recited in claim 2, wherein the treadmill is less than about 7 inches in height when the handrail is in the folded position and the treadbase is in a neutral position.

4. A treadmill as recited in claim 2, wherein the treadmill is less than about 6 inches in height when the handrail is in the folded position and the treadbase is in a neutral position.

5. A treadmill as recited in claim 1, wherein the treadmill comprises a motor assembly having first and second flywheels.

6. A treadmill as recited in claim 1, wherein the treadmill comprises a motor assembly having a motor and a flywheel, the motor being movably coupled to the flywheel, wherein the flywheel is coupled to a rotating member which is separate from a drive shaft of the motor.

7. A treadmill as recited in claim 6, wherein the flywheel is coupled to a roller of the treadbase, and wherein a drive belt movably couples the flywheel to the motor.

8. A treadmill as recited in claim 1, wherein the treadmill comprises a user console that is pivotally coupled to the handrail.

9. A treadmill as recited in claim 8, wherein the console is in wireless communication with the motor.

10. A treadmill as recited in claim 8, wherein the console is in wireless communication with a controller, the controller being electrically coupled to one of: (i) the motor; and (ii) an incline motor.

11. A treadmill as recited in claim 8, wherein the wireless communication is selected from the group consisting of: (i) infared communication; (ii) radio frequency communication; (iii) digital wireless communication; (iv) analog communication; (iv) 802.11 RF; (v) bluetooth communication; and (vi) electromagnetic wavepulse.

12. A treadmill as recited in claim 1, further comprises at least one glider mounted on a lower surface of the treadmill, the glider configured to glide on a support surface on which the treadmill is mounted.

13. A treadmill as recited in claim 12, wherein the glider comprises a polymeric material.

14. A treadmill as recited in claim 12, further comprising a wheel coupled to the treadmill, the wheel selectively rotating about a horizontal axis and pivoting about a vertical axis.

15. A treadmill as recited in claim 12, further comprising a fixed wheel which rotates about a horizontal axis.

16. A treadmill as recited in claim 12, wherein the glider comprises a reversible glider which is selectively coupled to the treadmill, the glider having a smooth polymeric surface on one side and a soft, deformable material on an opposing side.

17. A treadmill as recited in claim 1, further comprising a wheel coupled to the treadbase that selectively rotates about a horizontal axis and pivots about a vertical axis.

18. A treadmill as recited in claim 1, further comprising a pair a wheels coupled to the lower surface of the treadbase which selectively rotate about a horizontal axis and pivot about a vertical axis and at least one glider coupled to a lower surface of the treadmill.

19. A treadmill as recited in claim 1, further comprising means for retaining the handrail in a desired position.

20. A treadmill as recited in claim 19, wherein the means for retaining the handrail in a desired position comprises a shock.

21. A treadmill as recited in claim 20, wherein the shock comprises a gas shock.

22. A treadmill as recited in claim 20, wherein the user selectively actuates the shock to move the handrail to a desired position.

23. A treadmill as recited in claim 1, further comprising at least one handle on the treadbase for selectively moving the treadbase.

24. A treadmill as recited in claim 23, wherein the handle is selected from the group consisting of a strap, a configuration within the treadmill defining a recess, and a grip.

25. A treadmill as recited in claim 23, wherein the handle comprises a grip member and a glide.

26. A treadmill as recited in claim 1, further comprising a shock member extending between the handrail and the frame, the shock member comprising:

a shock; and a trigger coupled to the shock, the trigger selectively actuating the shock.

27. A treadmill having a motorized treadbase and a folding handrail, the handrail folding with respect to the treadbase such that the treadmill achieves a low profile when the handrail is in a folded position, the treadmill comprising:

a treadbase, the treadbase comprising first and second rollers and an endless belt movably trained about the first and second rollers, the treadbase configured to be mounted on a support surface while a user exercises thereon;

a motor coupled to the treadbase, the motor also being movably coupled to the first roller such that the motor selectively turns the first roller, thereby causing the belt to move;

first and second flywheels coupled to the motor; and a handrail pivotally coupled to the treadbase, the handrail selectively folding downwardly toward the treadbase, such that the treadbase can be in a substantially horizontal orientation during use and during storage and such that the treadmill is less than about 8 inches in height when the handrail is in a folded position.

28. A treadmill as recited in claim 27, wherein the first and second flywheels are coupled to drive shaft extending from opposing sides of the motor.

29. A treadmill having a motorized treadbase and a folding handrail, the handrail folding with respect to the treadbase such that the treadmill achieves a low profile when the handrail is in a folded position, the treadmill comprising: a treadbase, the treadbase comprising first and second rollers and an endless belt movably trained about the first and second rollers;

a motor coupled to the treadbase, the motor also being movably coupled to the first roller such that the motor selectively turns the first roller, thereby causing the belt to move;

a handrail pivotally coupled to the treadbase, the handrail selectively folding downwardly toward the treadbase, such that the treadmill is less than about 8 inches in height when the handrail is in a folded position; and a glide mounted on a lower surface of the treadbase.

* * * * *

UNITED STATES PATENT AND TRADEMARK OFFICE

CERTIFICATE OF CORRECTION

PATENT NO. : 6,471,622 B1
DATED : October 29, 2002
INVENTOR(S) : Rodney L. Hammer et al.

It is certified that error appears in the above-identified patent and that said Letters Patent is hereby corrected as shown below:

Column 1,
Line 65, change “objection” to -- object --

Column 2,
Line 4, change “objection” to -- object --

Column 3,
Line 39, change “comer” to -- corner --

Column 5,
Lines 23, 24 and 34, change “comers” to -- corners --
Lines 55-56, after “of handrail” insert -- 14 --

Column 6,
Line 3, after “ABS plastic” delete “, for example”
Lines 36 and 37, change “comers” to -- corners --

Column 8,
Line 11, after “distal” insert -- end --
Line 49, after “handrail” insert -- 14 --
Line 51, change “comer” to -- corner --
Line 59, change “comers” to -- corners -- in both instances Column 9,
Line 5, change “comers” to --corners --

Column 10,
Line 12, change “13” to -- 14 --

Column 13,
Line 44, change “(iv)” to -- (v) --
Line 44, change “(v)” to -- (vi) --
Line 45, change “(vi)” to -- (vii) --

UNITED STATES PATENT AND TRADEMARK OFFICE

CERTIFICATE OF CORRECTION

PATENT NO. : 6,471,622 B1
DATED : October 29, 2002
INVENTOR(S) : Rodney L. Hammer et al.

It is certified that error appears in the above-identified patent and that said Letters Patent is hereby corrected as shown below:

Column 14,
Line 48, before "drive shaft" insert -- a --

Signed and Sealed this

First Day of July, 2003

JAMES E. ROGAN
*Director of the United States Patent and Trademark Office*